US007460080B1

(12) United States Patent
Watson, III

(10) Patent No.: US 7,460,080 B1
(45) Date of Patent: Dec. 2, 2008

(54) REDUCING DRAG CAUSED BY WIND LOADS ON COMMUNICATION TOWER APPURTENANCES

(76) Inventor: Thomas B. Watson, III, 1036 Chandelle Lake Dr., Pensacola, FL (US) 32507

( * ) Notice: Subject to any disclaimer, the term of this patent is extended or adjusted under 35 U.S.C. 154(b) by 149 days.

(21) Appl. No.: 11/267,456

(22) Filed: Nov. 4, 2005

(51) Int. Cl.
*H01Q 1/42* (2006.01)

(52) U.S. Cl. ..... 343/872

(58) Field of Classification Search ..... 343/872, 343/874, 702, 700 MS, 853
See application file for complete search history.

(56) References Cited

U.S. PATENT DOCUMENTS 5,621,420 A * 4/1997 Benson ..... 343/791
5,757,324 A * 5/1998 Helms et al. ..... 343/700 MS
6,339,409 B1 * 1/2002 Warnagiris ..... 343/895
6,388,622 B1 * 5/2002 Jennetti et al. ..... 343/700 MS
6,414,605 B1 * 7/2002 Walden et al. ..... 340/870.02
6,445,358 B2 * 9/2002 Takahashi et al. ..... 343/828
6,756,949 B2 * 6/2004 Schadler ..... 343/890
2005/0088350 A1 * 4/2005 Murry et al. ..... 343/702

* cited by examiner

*Primary Examiner*—Huedung Mancuso
(74) *Attorney, Agent, or Firm*—Kenneth W. Float

(57) ABSTRACT

Apparatus and methods that reduce drag resulting from wind loads on antenna appetencies exposed to winds. An aerodynamically shaped outer housing made of a material that does not impede transmission or reception of radio frequency energy is assembled and attached to a support post of an communication tower appurtenance that is attached to a communication tower such that the housing does not physically contact the appurtenance. The aerodynamically shaped outer housing changes the surface geometry of the appurtenance from flat to round. Also, an aerodynamically shaped shroud may be assembled and attached to a flat-sided member that interconnects multiple appurtenances so that the surface geometry of the flat-sided member is changed from flat to round. Based upon the ANSI/TIA-222-G specification for such antenna appurtenances, a reduction in drag caused by wind loading is on the order of about 45 percent.

14 Claims, 14 Drawing Sheets

10
11
12
13
16
21
22
23
30
31
32
32a
33
34
35
35a
35b
3d
3e 10
11
12
13
15
30
33
34
35
36a
36b
37
38
39
39a
39b
6d 22
11a
21
23
16
11a
10a
18
16
18
22

8d
22
11a
21
23
10a
16
8d 23
22
22a
16
11a
21
10a 23
21
16
10a
11a 22
16
32a
11a
32
21
23
31
32b
32d
18
9d
32c
10a 34
23
35
36c
10a
36d
36a
21
36b
32

35
36b
10a
34
11a
37
11a 12d
35
36a
11a
36e
10a
37
38
36b
12d
35

21
36a
36b
11a
34
23
10a
37
23
35
35

10
11a
12d
23
34
35
36a
36b
36e
37
38
39
39a
39b

Table 1

Force coefficients (Ca) for appurtenances

| Member type | | Aspect ratio ≤ 2.5 | Aspect ratio = 7 | Aspect ratio ≥ 25 |
|---|---|---|---|---|
| | | Ca | Ca | Ca |
| Flat | | 1.2 | 1.4 | 2.0 |
| Round | C < 32 [4.4] (subcritical) | 0.7 | 0.8 | 1.2 |
| | 32 < C < 64 [4.4 ≤ C ≤ 8.7] | $3.76\|(C)^{0.485}$ $[1.43\|(C)^{0.485}]$ | $3.76\|(C)^{0.415}$ $[1.43\|(C)^{0.415}]$ | $3.76\|(C)^{1.0}$ $[1.43\|(C)^{1.0}]$ |
| | C > 64 [8.7] (supercritical) | 0.50 | 0.60 | 0.60 |

REDUCING DRAG CAUSED BY WIND LOADS ON COMMUNICATION TOWER APPURTENANCES

BACKGROUND

The present invention relates to apparatus and methods for reducing drag caused by wind loads on appurtenances mounted on communication towers.

Communication tower appurtenances, such as communication antennas mounted on tall communication towers are structures that are typically attached to brackets or to platforms attached to the towers. Typical communication antennas are flat, which means that they can experience substantial wind loading when the flat surfaces are normal to the wind direction. When exposed to high winds, such antennas, and other antenna tower appurtenances, experience high wind loads.

Wind loading governs the design of all communication tower appurtenances as per ANSI/TIA-222-G (Effective Jan. 1, 2006), which is the commonly accepted standard.

It would be desirable to have apparatus and methods for reducing drag resulting from wind loads on communication tower appurtenances, such as communication antennas exposed to winds.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

The basic concept disclosed herein involves reducing drag forces on existing communication tower appurtenances, such as communication antennas, and the like, by changing their surface geometry of the appurtenances from flat to round. Members used to interconnect the appurtenances may also be configured to change their surface geometry from flat to round.

Figure 1D:
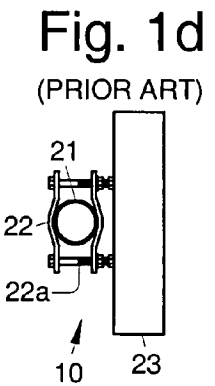
Fig. 1d (PRIOR ART)
FIGS. 1*a*-1*e* are isometric, rear, side and sectional views of an embodiment of a conventional platform-mounted communication antenna.
Figure 1E:
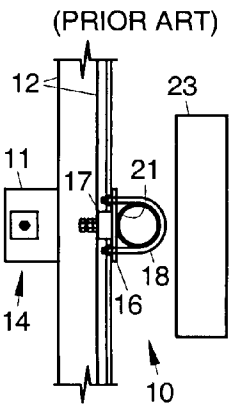
Fig. 1e (PRIOR ART)
Figure 1C:
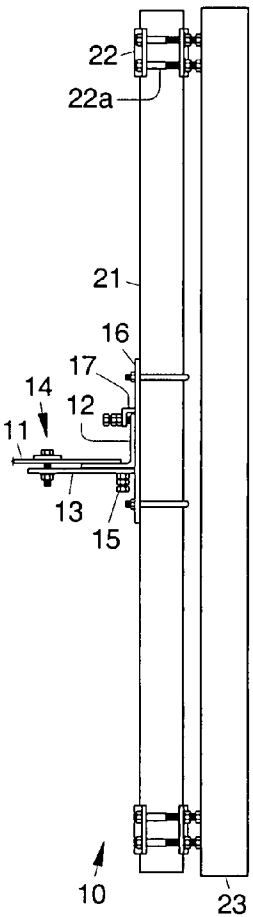
Fig. 1c (PRIOR ART)
Figure 1B:
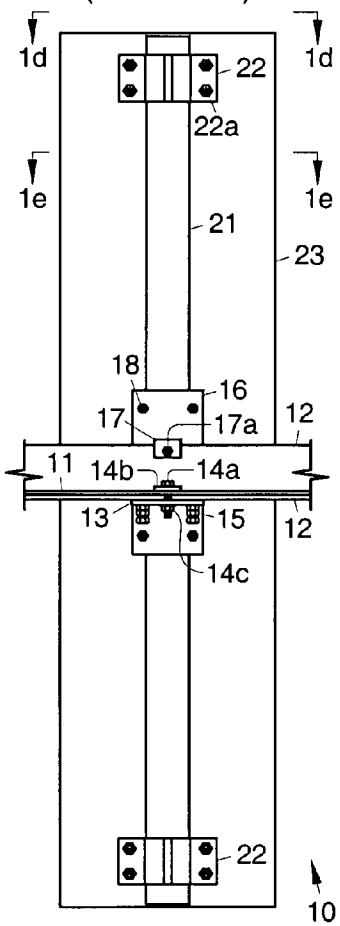
Fig. 1b (PRIOR ART)
Figure 1A:
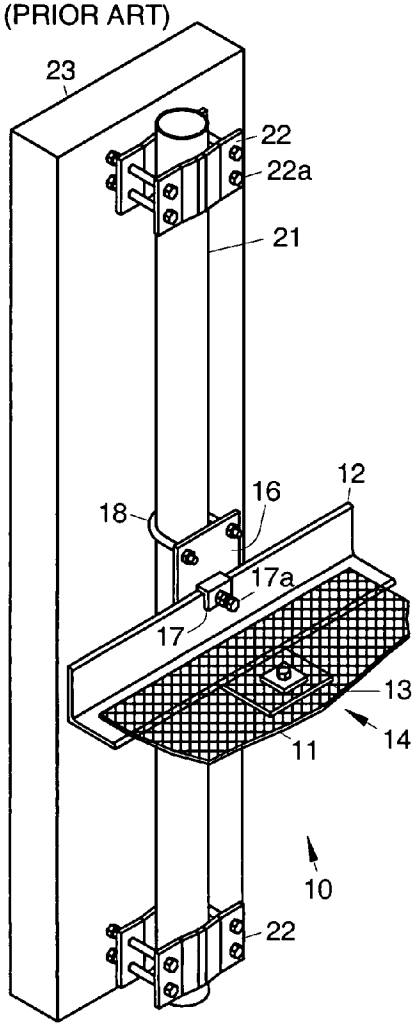
Fig. 1a (PRIOR ART)
Figures 2A, 2B, 2C, 2D, 2E:
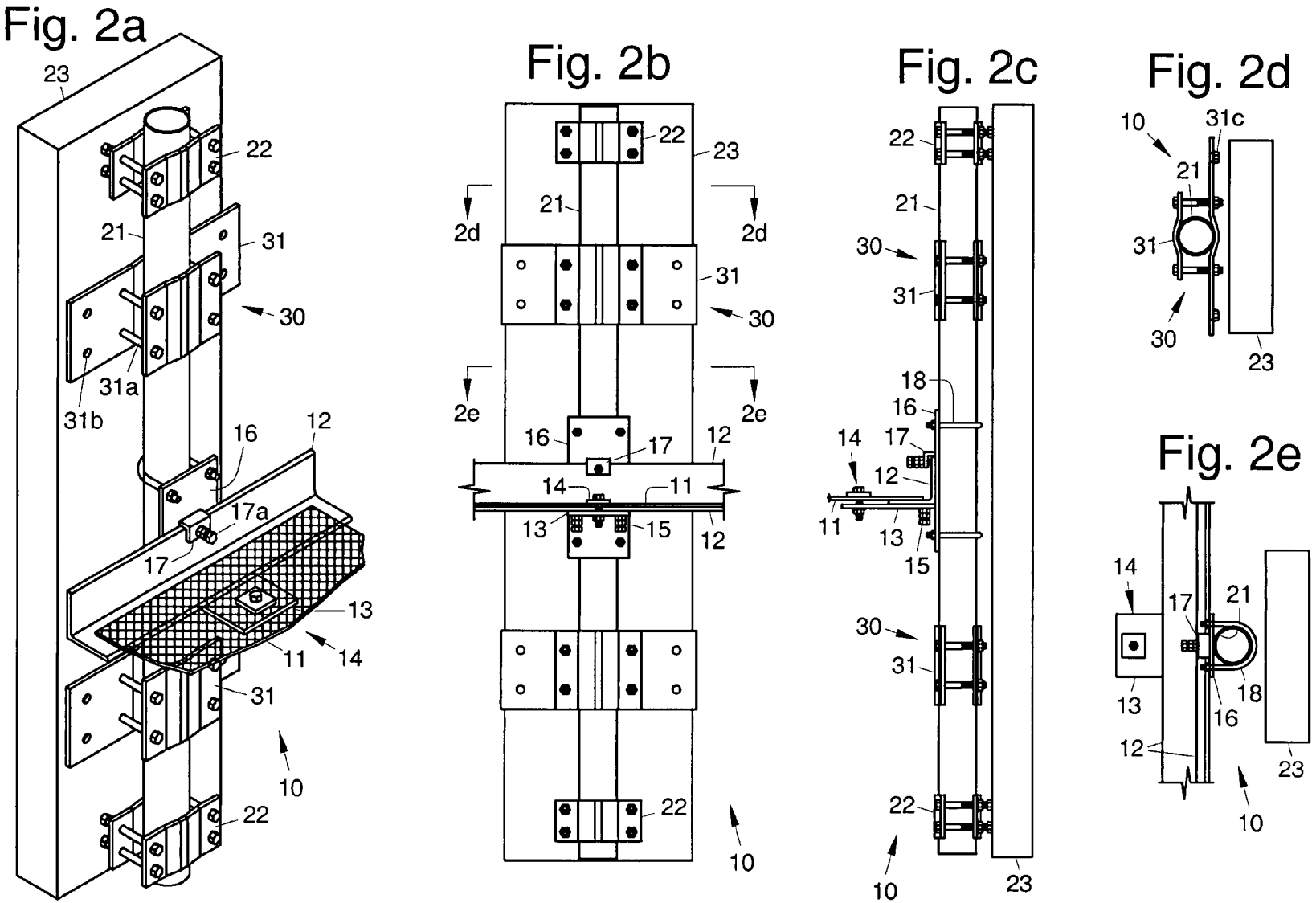
FIGS. 2*a*-2*e*, FIGS. 3*a*-3*e*, FIGS. 4*a*-4*e*, FIGS. 5*a*-5*e*, and FIGS. 6*a*-6*d* are isometric, rear, side and sectional views illustrating construction of apparatus for reducing drag resulting from wind loads on the platform-mounted communication antenna shown in FIGS. 1*a*-1*e*.

Referring to the drawing figures, FIGS. 1*a*-1*e* are isometric, rear, side and sectional views of an embodiment of a conventional platform-mounted communication antenna 10. FIG. 1*d* is a sectional view taken along lines 1*d*-1*d* shown in FIG. 1*b*. FIG. 1*e* is a sectional view taken along lines 1*e*-1*e* shown in FIG. 1*b*.

The platform-mounted communication antenna 10 comprises a platform grating 11 that is part of an antenna tower and to which the antenna 10 is attached. The platform grating 11 is a metal mesh structure which has openings therethrough. An angle bracket 12 is a part of the platform which is secured to the tower structure and the platform grating 11 is secured to the angle bracket 12 by means of a plate 13 along with securing apparatus 14 comprising a bolt 14*a*, washer 14*b*, and nut 14*c* that extends through the mesh structure of the platform grating 11 at one end of the plate 13. The opposite end of the plate 13 has a plurality of lockable bolts 15 that extend through the plate 13 and into the angle bracket 12 to secure the platform grating 11 to the angle bracket 12.

A support post bracket 16 is secured to an antenna support post 21 by means of a plurality of U-bolts 18, for example. An L-shaped protrusion 17 from the support post bracket 16 engages the top edge of the support post bracket 16 and is secured thereto using a machine screw 17*a*, for example.

Two antenna support brackets 22 are secured to the antenna support post 21 using a plurality of machine screws 22*a*, for example. The machine screws 22*a* also screw into mating threaded holes in an antenna radiator 23 and secure the antenna radiator 23 to the antenna support post 21.

It should be clear from FIGS. 1*a*-1*e* that the antenna radiator 23 is flat, and thus can experience substantial wind loading when its flat surfaces are normal to the wind direction. Wind load reduction apparatus 30 disclosed below address this problem and is designed to change the surface geometry of the antenna radiator 23 and certain other exposed structures of the tower 11 from flat to round. FIGS. 2-6 illustrate individual components that are used to implement the wind load reduction apparatus 30.

FIGS. 1*a*-1*e* show a typical flat panel antenna 10 mounted on a platform 11. The dimensions for flat panel antennas 10 vary widely, and vertical lengths can range from 18" to 96", horizontal widths can range from 2" to 24" and thickness can range from 2" to 8". Table 1, which corresponds to Table 2-8 from the ANSI/TIA-222-G code, shows force coefficients (Ca) for appurtenances mounted on an antenna tower. The aspect ratio is defined as the quotient of the height divided by the width. Using dimensions of 48" in height and 12" in width, the aspect ratio is 4.0, and the Ca value is 1.27 for the flat panel antenna 10. By placing a 15" diameter cylindrical surface comprising wind load reduction apparatus 30 around the flat panel antenna 10, the aspect ratio is 3.4 and the corresponding Ca value is 0.52 for a round profile. The result of enclosing the flat panel antenna 10 in a cylindrical shroud is a reduction in drag of about 45 percent. Wind load reduction apparatus 30 that accomplishes this is discussed below.

There may be a multitude of specific designs that can encapsulate a flat panel antenna 10 mounted on a platform 11 with a cylindrical shroud. The design described herein accomplishes the desired results without any part of the encapsulating apparatus coming in contact with the antenna 10. FIGS. 2*a*-2*e* illustrate isometric, rear, side and sectional views of the platform-mounted antenna 10 showing hinge bracket clamps 31 used in the wind load reduction apparatus 30. Two hinge bracket clamps 31 are attached to the antenna support post 21 using a plurality of machine screws 31*a*, for example. The hinge bracket clamps 31 do not touch the antenna radiator 23. The hinge bracket clamps 31 have through holes 31*b* disposed therein with nuts 31*c* attached (such as by welding, for example) to a front surface thereof.

FIGS. 3*a*-3*e* illustrate isometric, rear, side and sectional views of the platform-mounted antenna 10 showing hinge brackets 32 and a platform angle rail shield 33 used in the wind load reduction apparatus 30. The hinge brackets 32 are semicircular in shape and have two L-shaped brackets 32*a* attached to an inner surface. The hinge brackets 32 have a plurality of access holes 32*b* disposed that are aligned with through holes 32*b* in the L-shaped brackets 32*a*. A plurality of machine screws may be inserted through the access holes 32*b* which are captivated by nuts disposed adjacent to the opposite surface of the hinge brackets clamp 31. The hinge brackets 32 have holes 32*c* (FIG. 3*c*) located adjacent to respective ends thereof that are used to attach portions of hinges 35 (FIGS. 4*a*-4*d*) thereto that are used to attach a semicircular front shield 34 (FIGS. 4*a*-4*d*) thereto. The hinge brackets 32 have a plurality of openings 32*d* disposed on respective lateral sides thereof.

Figure 3D:
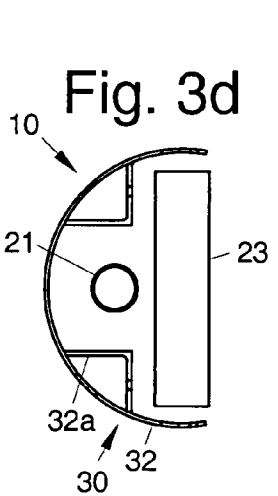
Figure 3E:
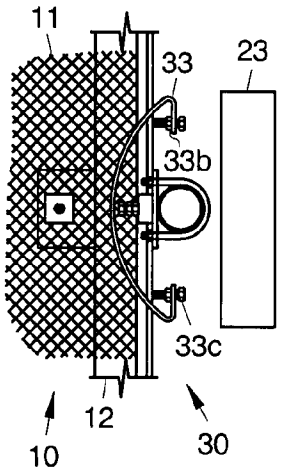
Figure 3C:
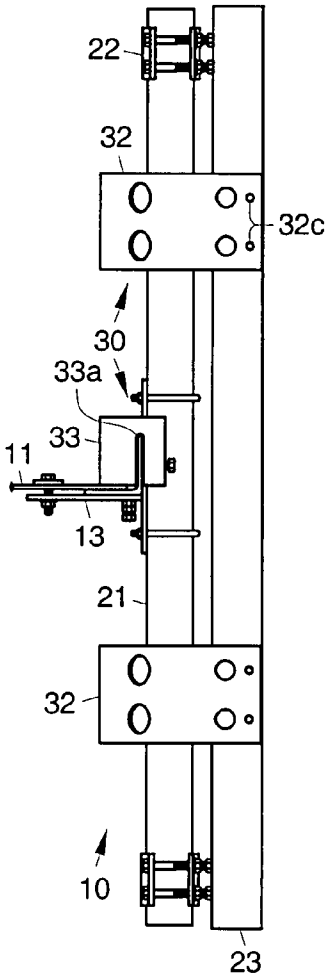
Figure 3B:
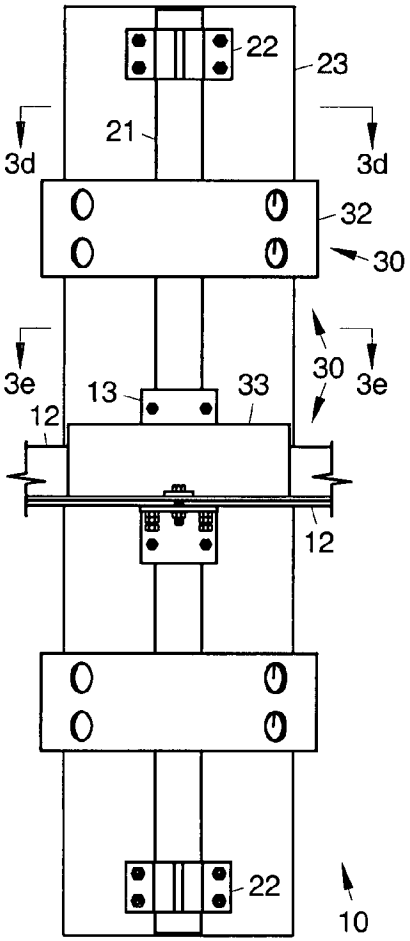
Figure 3A:
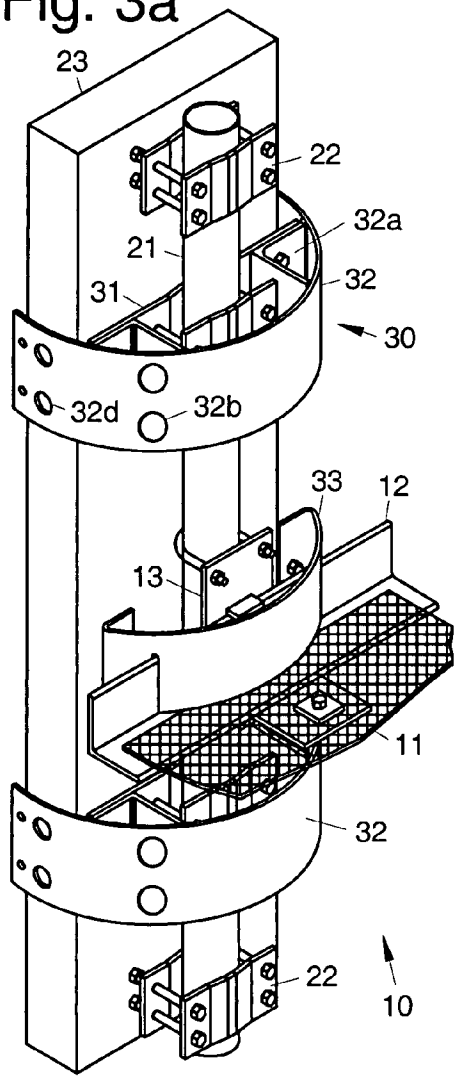

The platform angle rail shield 33 is a plate that has a truncated circular shape with flat bent ends that are more-or-less parallel to the vertical surface of the angle bracket 12. The platform angle rail shield 33 has two notches 33*a* formed therein that allow it to slide over the angle rail 12. The platform angle rail shield 33 has through holes disposed in the flat bent ends thereof. Referring to FIG. 3*e*, nuts 33*b* are attached (such as by welding, for example) an inner surface of the bent ends of the platform angle rail shield 33. Machine screws 33*c* may be threaded through the nuts 33*b* to secure the platform angle rail shield 33 to the platform angle rail 12. The platform angle rail shield 33 provides a circular surface for mating to the inside surfaces of two upper rear shields 36*a*, 36*b* (FIGS. 5*a*-5*e*).

Figures 4A, 4B, 4C, 4D, 4E:
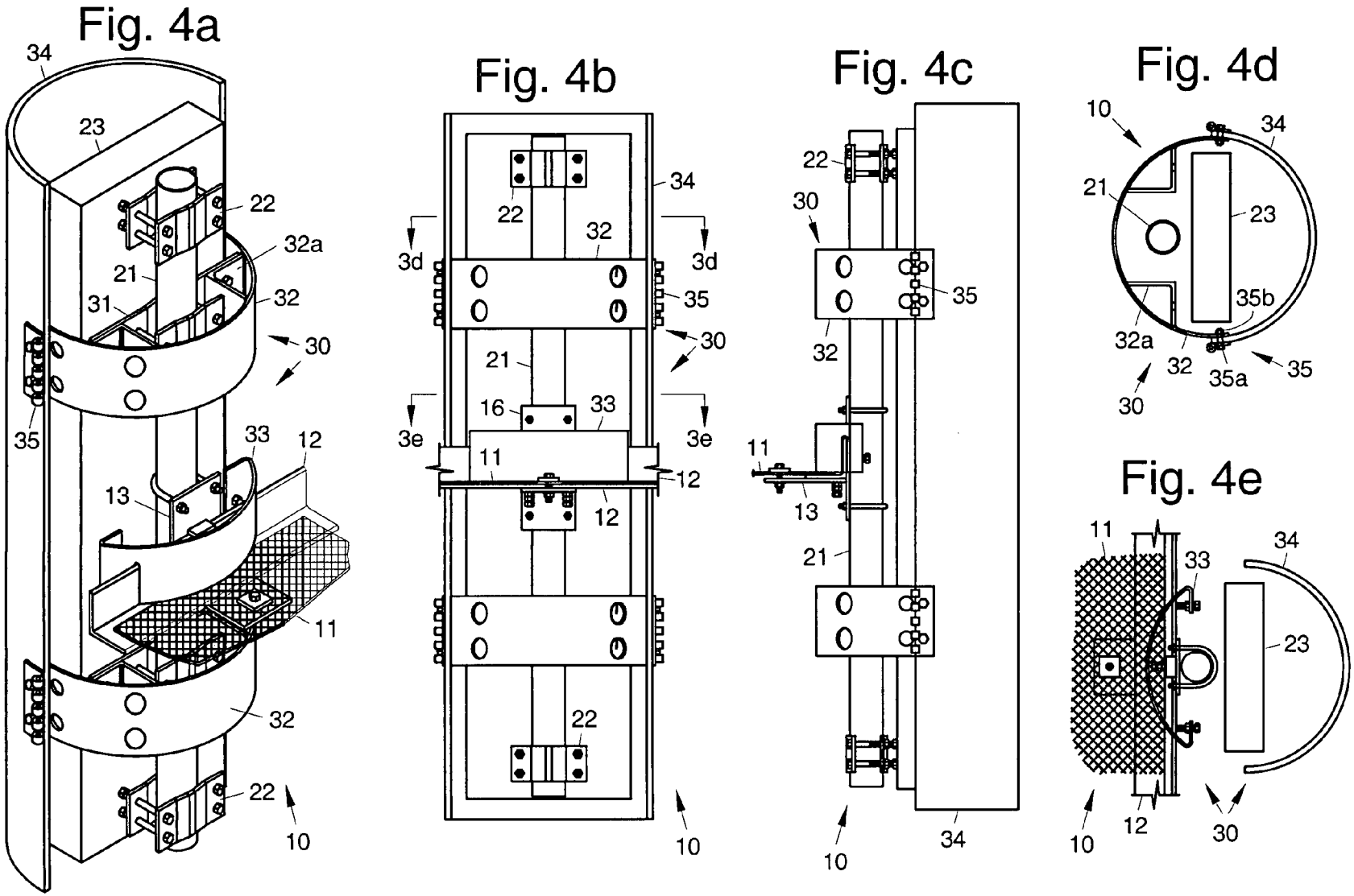

FIGS. 4*a*-4*e* illustrate isometric, rear, side and sectional views of the platform-mounted antenna 10 showing a front shield 34 attached to hinge brackets 32. The front shield 34 is made of a material that does not impede transmission or reception of radio frequency energy. The hinge portions 35 are secured to the hinge brackets 32 by inserting machine screws 35*a* through holes in the front shield 34 and holes in the hinge brackets 32 and threading them through nuts 35*b* adjacent to the inner surfaces of the hinge brackets 32 (FIG. 4*d*).

Figures 5A, 5B, 5C, 5D, 5E:
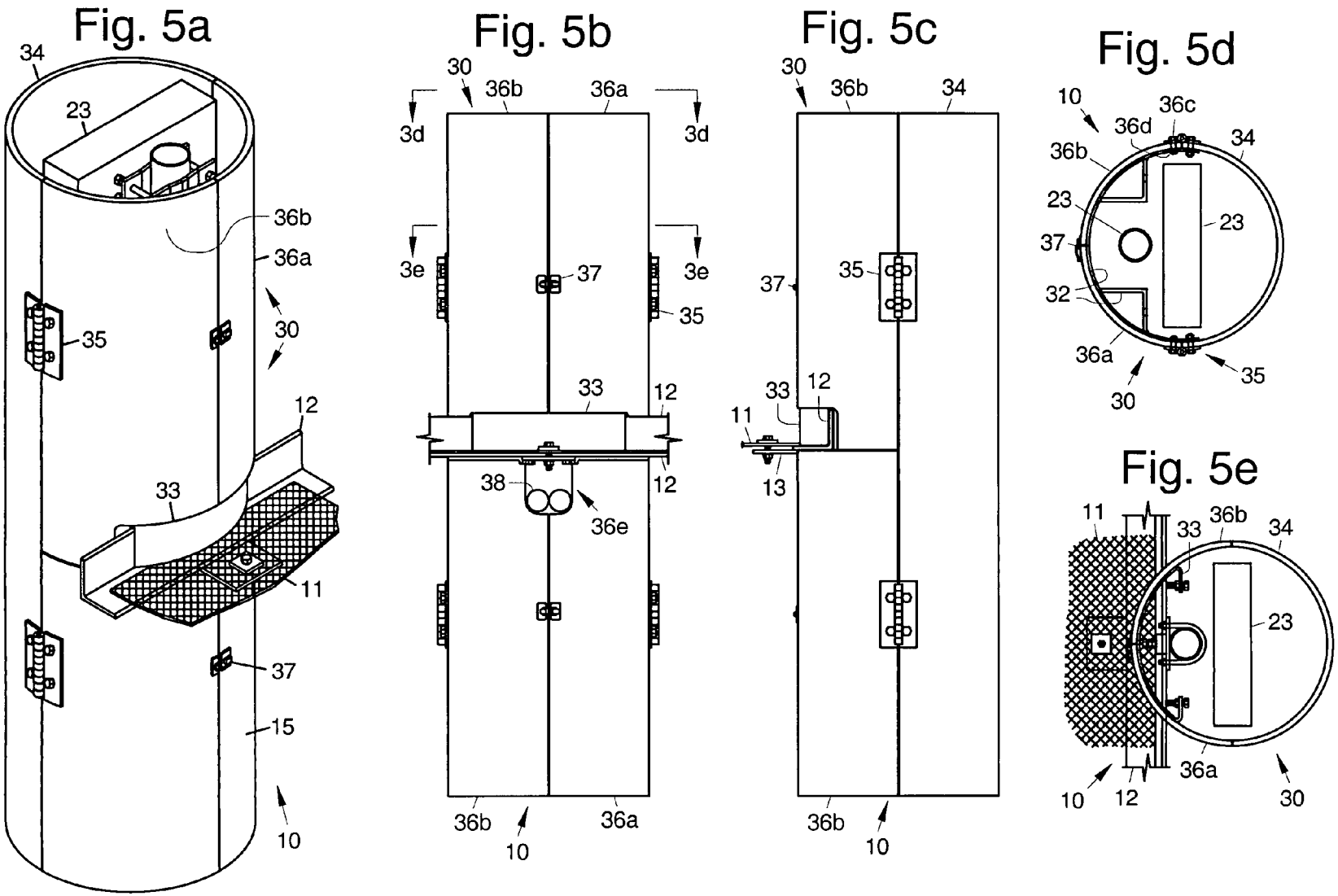
Figures 6A, 6B, 6C, 6D:
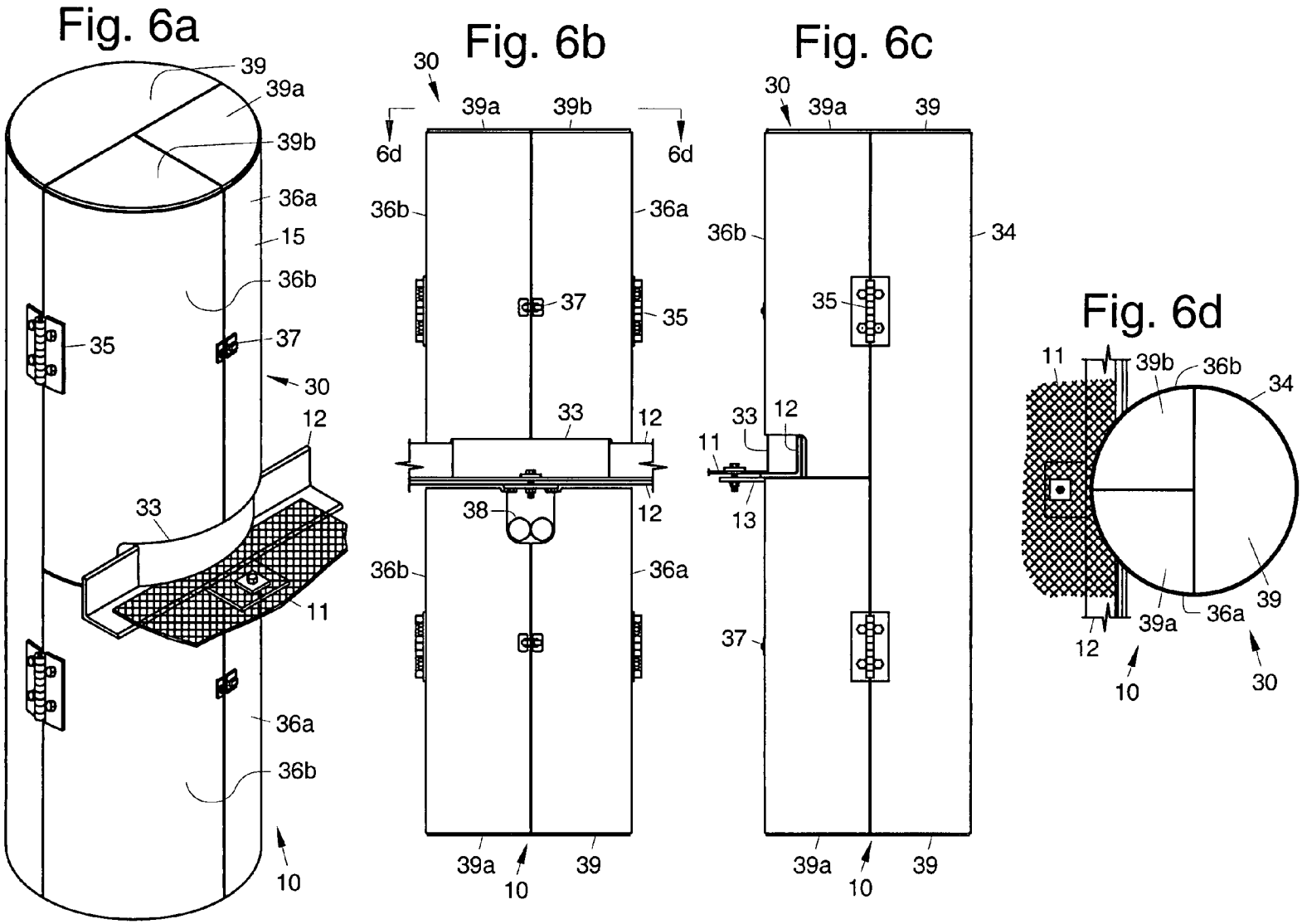

FIGS. 5*a*-5*d* illustrate isometric, rear, side and sectional views of the platform-mounted antenna 10 showing left and right pairs of rear shields 36*a*, 36*b*. The left and right pairs of rear shields 36*a*, 36*b* have mating portions of the hinges 35 attached thereto. The hinges 35 are pinned together allowing the respective pairs of rear shields 36*a*, 36*b* to rotate so that they open and close. The remaining hinge portions 35 are secured to the left and right pairs of rear shields 36*a*, 36*b* by inserting machine screws 36*c* through holes in the pairs of rear shields 36*a*, 36*b* and threading them through nuts 36*d* adjacent to the inner surfaces of the rear shields 36*a*, 36*b* (FIG. 5*d*). Adjacent abutting edges of the left and right pairs of rear shields 36*a*, 36*b* are configured with latches 37 that allow them to be locked in a closed position. Upper rear shields 36*a*, 36*b* are cut away to allow them to rotate past the angle rail 12 and platform angle rail shield 33. Lower rear shields 36*a*, 36*b* have adjacent cut away portions 36*e* that allow coaxial cables to be coupled to the antenna radiator 23. Access to the rear of the antenna 10 is provided by releasing the draw latches 37 and pivoting the rear shields 36*a*, 36*b* on their hinges 35.

FIGS. 6*a*-6*e* illustrate isometric, rear, side and sectional views of the platform-mounted antenna 10 showing top and bottom shields 39, 39*a*, 39*b* used in the wind load reduction apparatus 30. The top and bottom shields 39, 39*a*, 39*b* are respectively secured to the front shield and left and right pairs of rear shields 34, 36*a*, 36*b*, such as by adhesive, for example. The top and bottom shields 39, 39*a*, 39*b* are pre-attached to the front and rear shields 34, 36*a*, 36*b*. The front top and bottom shields 39, 39*a*, 39*b* are designed from a material which does not impede radio frequency energy transmission or reception. The top and bottom shields 39, 39*a*, 39*b* may be designed as flat shields as shown or may be domed, hemispherical or any other desired aerodynamic shape. The front and rear shields 34, 36*a*, 36*b*, in conjunction with the top and bottom shields 39, 39*a*, 39*b* encase the antenna radiator 23 in a cylindrical shroud or housing that is operative to reduce the wind load by a substantial factor, on the order of 45 percent for an antenna 10 having an aspect ratio of 3.4, for example.

Figure 7B:
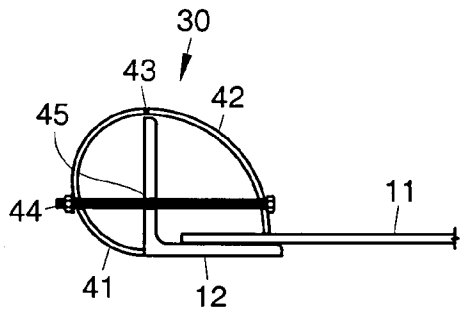
FIG. 7*b* is a sectional view of the apparatus shown in FIG. 7*a*.
Figure 7A:
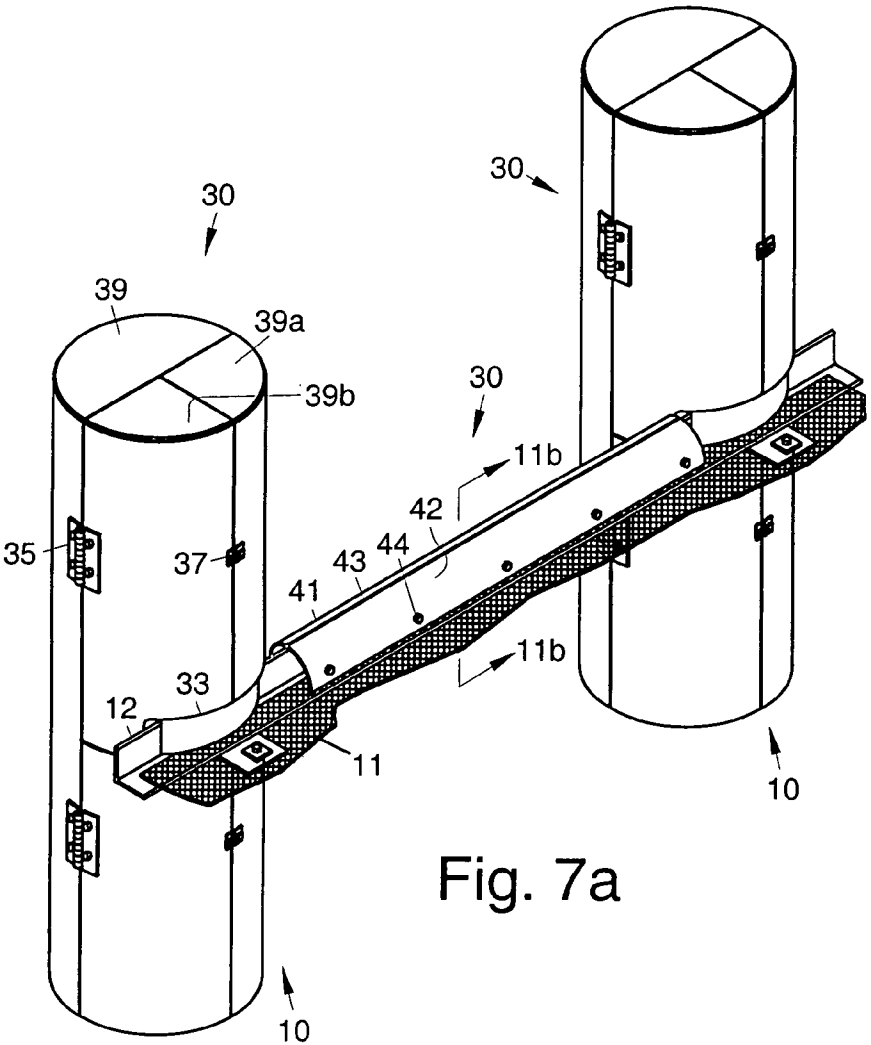
FIG. 7*a* is an isometric view of apparatus for reducing drag resulting from wind loads on an angle rail interconnecting two adjacent communication antennas.
Figures 8A, 8B, 8C, 8D:
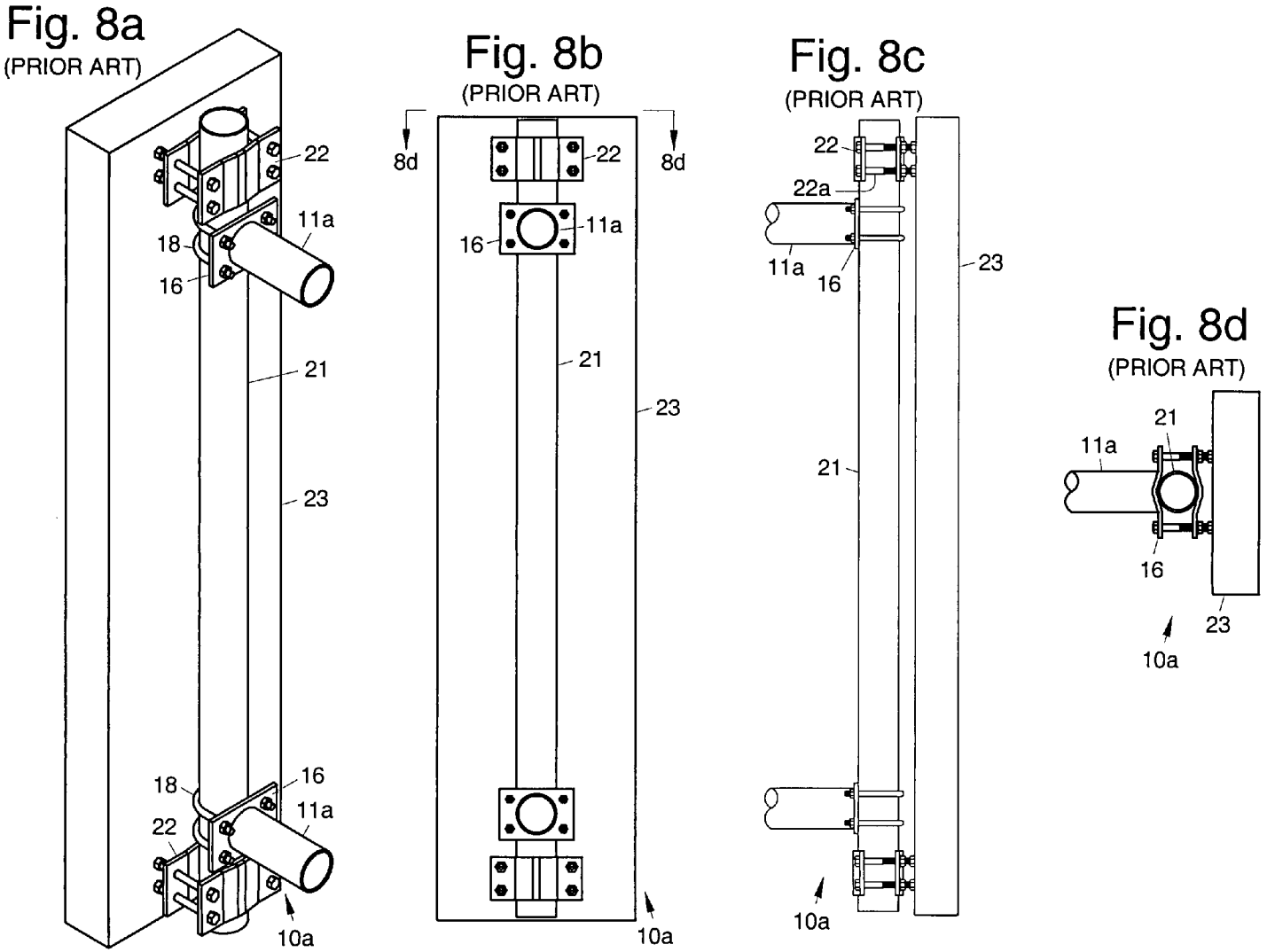
Fig. 8a (PRIOR ART)
Fig. 8b (PRIOR ART)
Fig. 8c (PRIOR ART)
Fig. 8d (PRIOR ART)
FIGS. 8*a*-8*d* arc isometric, rear, side and sectional views of an embodiment of a conventional standoff-bracket-mounted communication antenna.
Figure 9D:
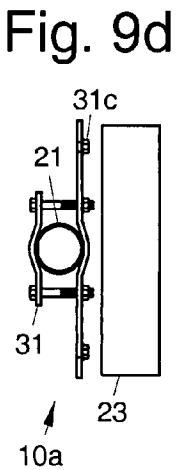
FIGS. 9*a*-9*d*, FIGS. 10*a*-10*d*, FIGS. 11*a*-11*d*, FIGS. 12*a*-12*d*, and FIGS. 13*a*-13*d* are isometric, rear, side and sectional views illustrating construction of apparatus for reducing drag resulting from wind loads on the standoff-bracket-mounted communication antenna shown in FIGS. 8*a*-8*d;*
Figure 9C:
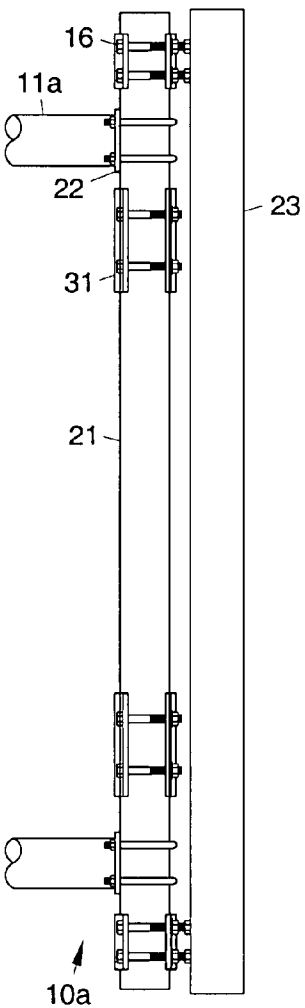
Figure 9B:
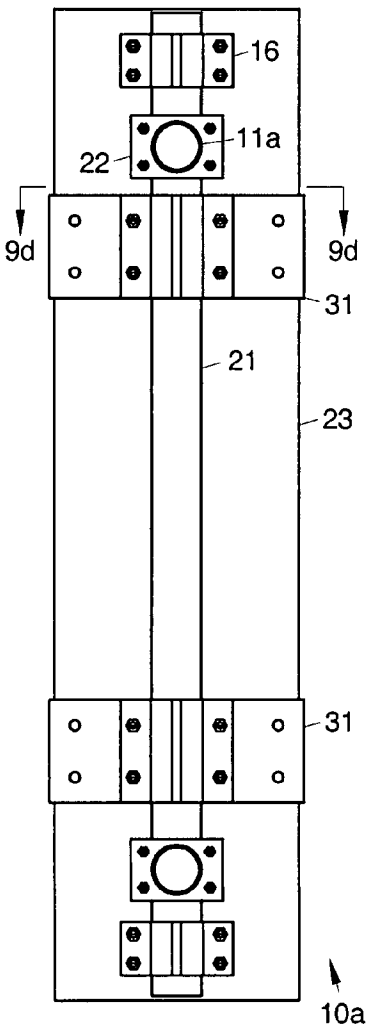
Figure 9A:
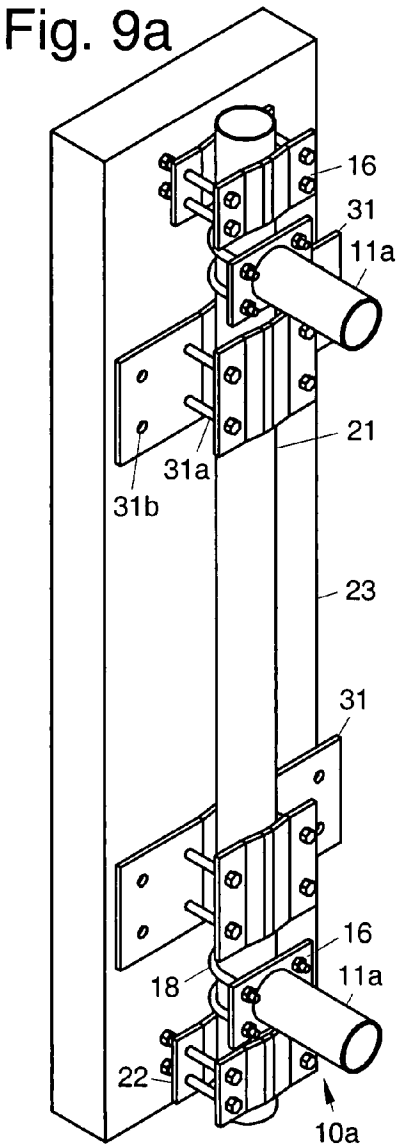
Figures 10A, 10B, 10C, 10D:
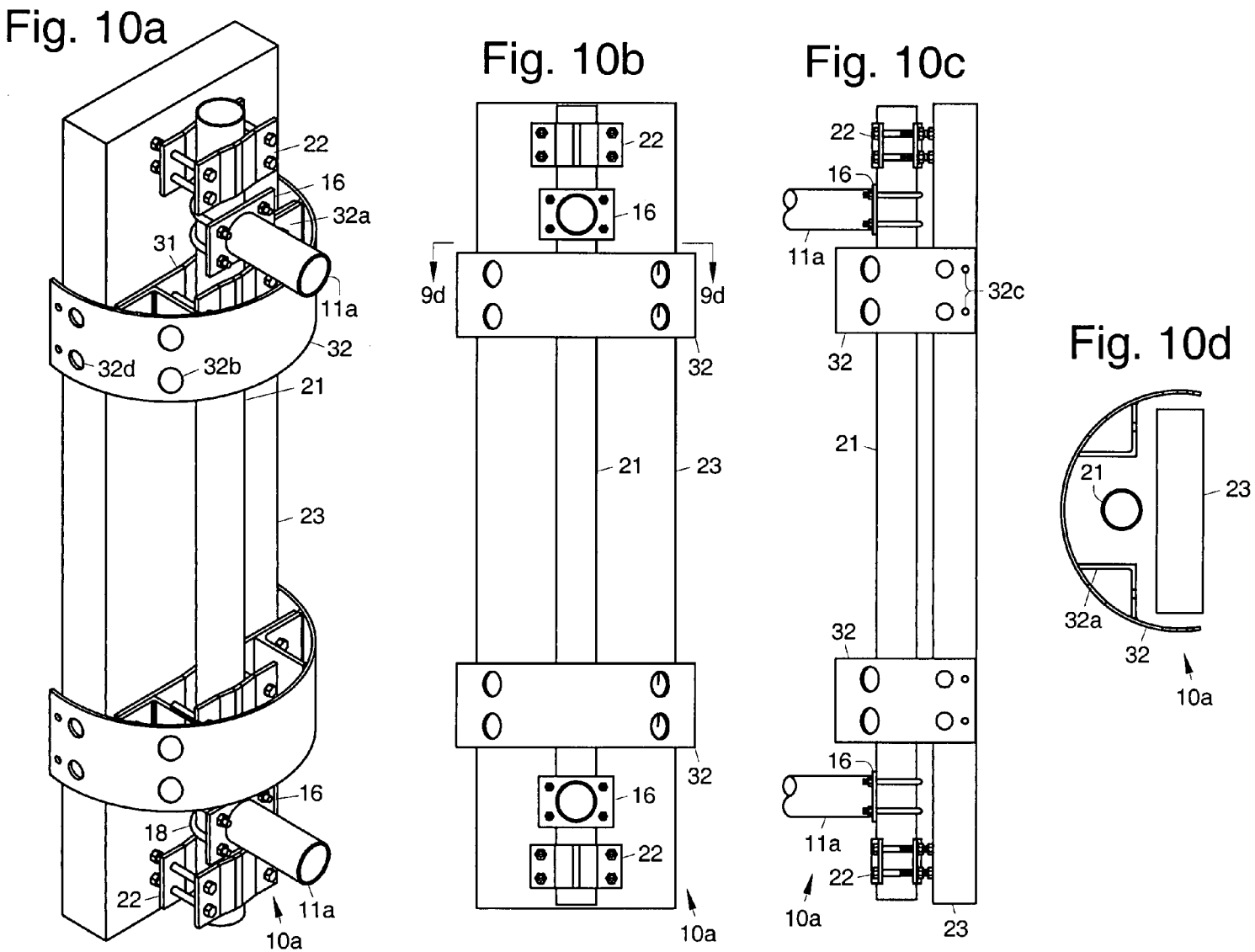
Figure 11D:
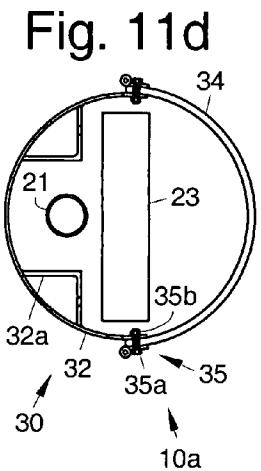
Figure 11C:
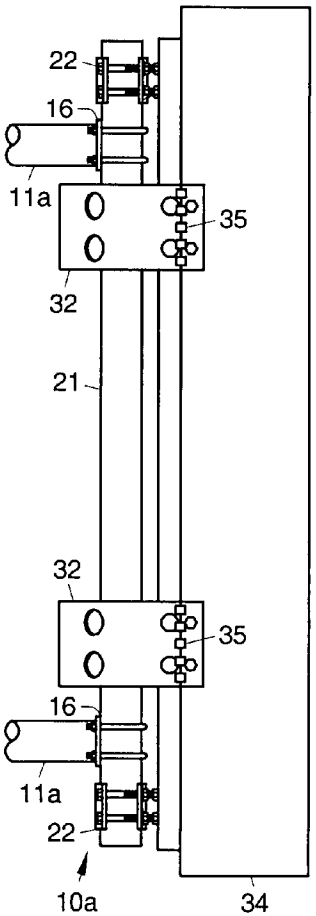
Figure 11B:
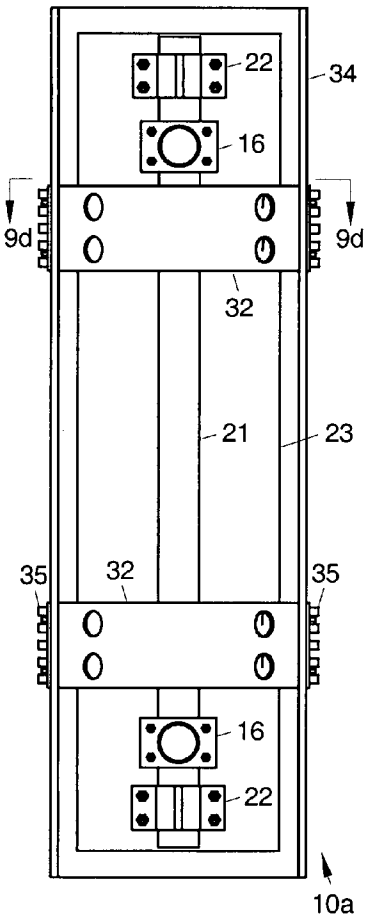
Figure 11A:
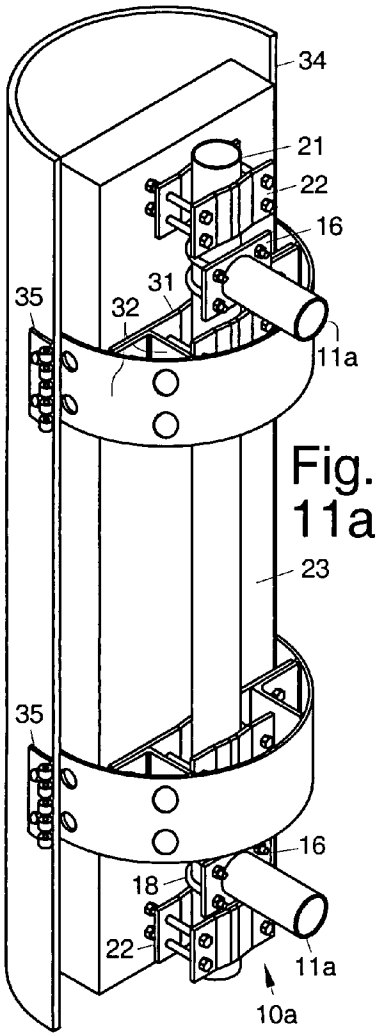
Figures 12A, 12B, 12C, 12D:
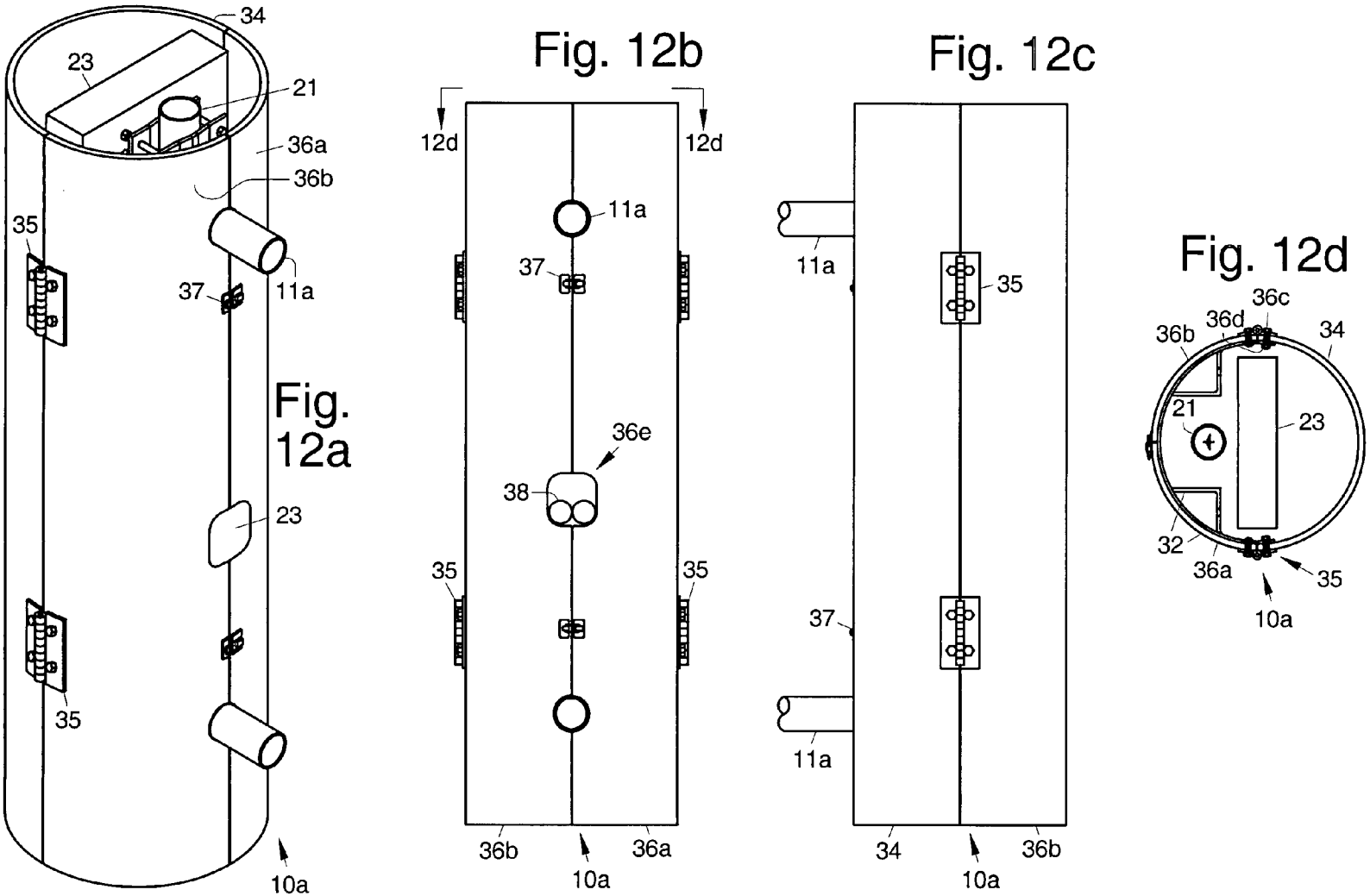
Figures 13A, 13B, 13C, 13D:
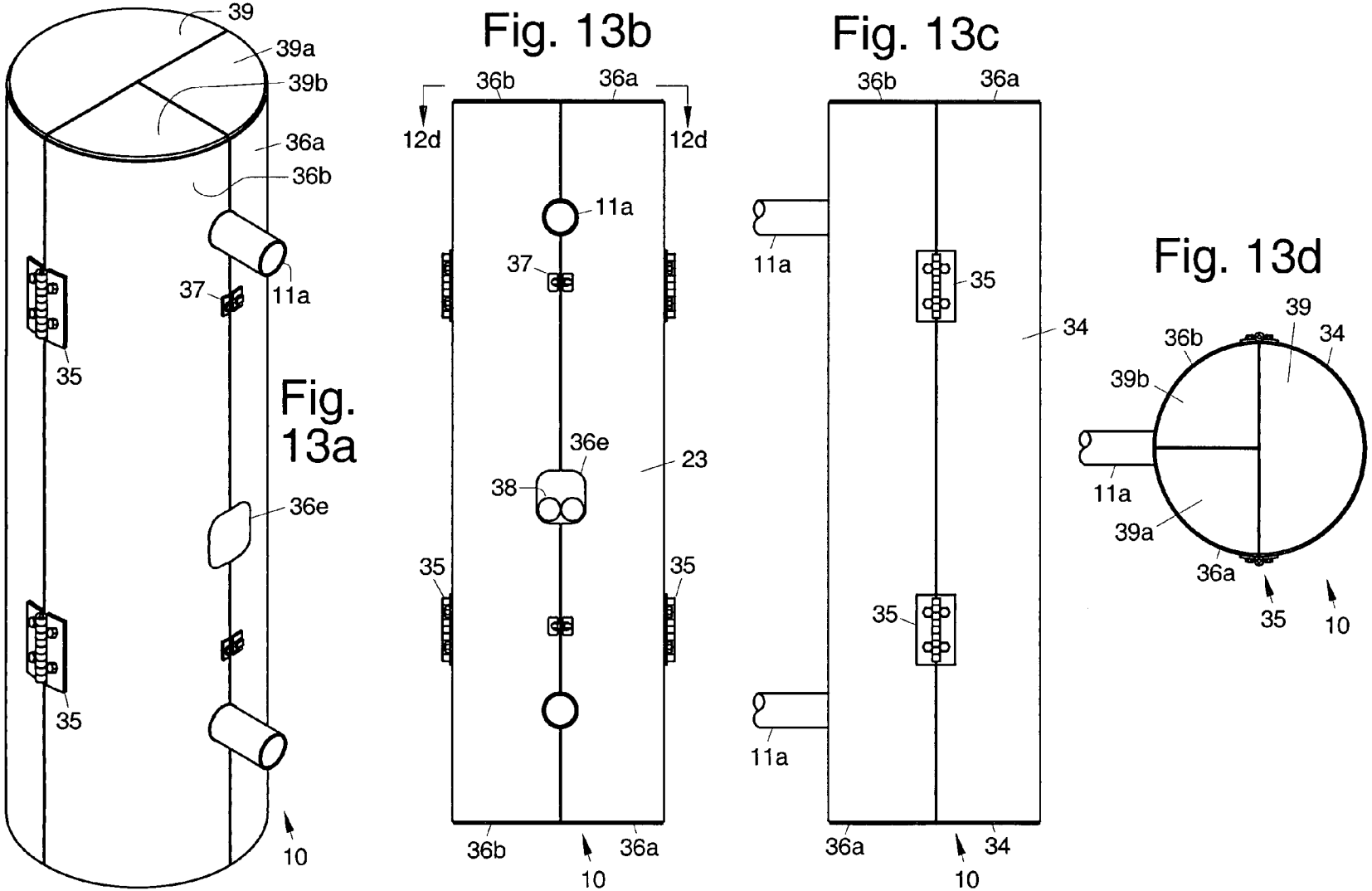

FIG. 7*a* is an isometric view of angle rail wind load reduction apparatus 30 for reducing drag resulting from wind loads on a flat-sided angle rail interconnecting two adjacent communication antennas 10. FIG. 7*b* is a sectional view of the apparatus 30 shown in FIG. 7*a*.

The angle rail wind load reduction apparatus 30 comprises a section of half pipe 41 that is attached, such as by welding 43 to a section of quarter pipe 42. This pipe structure is attached to the angle rail 12 using bolts 44 that are inserted through holes in the sections of pipe 41, 42 and angle rail 12 and using nuts through which the bolts 44 are threaded to secure the components in place. The angle rail wind load reduction apparatus 30 encases the angle rail 12 in a housing that is operative to reduce the wind load by a factor of from 45-65 percent.

Shielding of the angle rail 12 can reduce wind drag by 45 percent to 65 percent. As is shown in FIGS. 7*a* and 7*b*, this can easily be accomplished by welding a quarter of a piece of pipe (quarter pipe 42) with a diameter slightly less than half of the angle rail leg dimension to a half of a piece of pipe (half pipe 41) with a diameter slightly more than the angle rail leg dimension and bolting through the angle rail 12.

FIGS. 8*a*-8*d* are isometric, rear, side and sectional views of an embodiment of a conventional standoff-bracket-mounted communication antenna 10*a*. The construction of the standoff-bracket-mounted communication antenna 10*a* is similar to the design of the platform-mounted communication antenna 10 discussed above.

The standoff-bracket-mounted communication antenna 10*a* comprises one or more standoff support brackets 11*a* that are part of or are coupled to an antenna tower 11 and to which the antenna 10*a* is attached. The standoff support brackets 11*a* are metal tubes that secure the antenna 10*a* to the tower 11. The standoff support brackets 11*a* are secured to an antenna support post 21 by means of a plurality of U-bolts 18, for example.

Two antenna support brackets 22 are secured to the antenna support post 21 using a plurality of machine screws 22*a*, for example. The machine screws 22*a* also screw into mating threaded holes in an antenna radiator 23 and secure the antenna radiator 23 to the antenna support post 21.

FIGS. 9*a*-9*d*, FIGS. 10*a*-10*d*, FIGS. 11*a*-11*d*, FIGS. 12*a*-12*d*, and FIGS. 13*a*-13*d* are isometric, rear, side and sectional views illustrating construction of apparatus 30 for reducing drag from resulting wind loads on the standoff-bracket-mounted communication antenna 10*a* shown in FIGS. 8*a*-8*d*. More particularly, FIGS. 9*a*-*d* illustrate isometric, rear, side and sectional views of the standoff-bracket-mounted communication antenna 10*a* showing hinge bracket clamps 31 used in the wind load reduction apparatus 30. Two hinge bracket clamps 31 are attached to the antenna support post 21 using a plurality of machine screws 31*a*, for example. The hinge bracket clamps 31 have through holes 31*b* disposed therein with nuts 31*c* attached (such as by welding, for example) to a front surface thereof.

FIGS. 10*a*-10*d* are isometric, rear, side and sectional views of the standoff-bracket-mounted antenna 10*a* showing hinge brackets 32 used in the wind load reduction apparatus 30. The hinge brackets 32 are semicircular in shape and have two L-shaped brackets 32*a* attached to an inner surface. The hinge brackets 32 have a plurality of access holes 32*b* disposed that are aligned with through holes 31*b* in the L-shaped brackets 32*a*. A plurality of machine screws may be inserted through the access holes 32*b* which are captivated by nuts disposed adjacent the rear surface of the hinge brackets 32. The hinge brackets 32 have holes 32*c* located adjacent to respective ends thereof that are used to attach a semicircular front shield 34 and portions of hinges 35 thereto 35 (FIGS. 11*a*-11*d*). The hinge brackets 32 have a plurality of openings 32*d* disposed on respective lateral sides thereof. These openings 32*d* allow closure of rear shields 36*a*, 36*b* (FIGS. 12*a*-12*d*).

FIGS. 11*a*-11*d* illustrate isometric, rear, side and sectional views of the standoff-bracket-mounted antenna 10*a* showing a front shield 34 attached to hinge brackets 32. The front shield 34 is made of a material that does not impede transmission or reception of radio frequency energy. The hinge portions 35 are secured to the hinge brackets 32 by inserting machine screws 35*a* through holes in the front shield 34 and holes in the hinge brackets 32 and threading them through nuts 35*b* adjacent to the inner surfaces of the hinge brackets 32 (FIG. 4*d*).

FIGS. 12*a*-12*d* illustrate isometric, rear, side and sectional views of the standoff-bracket-mounted antenna 10*a* showing left and right rear shields 36*a*, 36*b*. The left and right rear shields 36*a*, 36*b* have mating portions of the hinges 35 attached thereto. The hinges 35 are pinned together allowing the respective rear shields 36*a*, 36*b* to rotate so that they open and close. The remaining hinge portions 35 are secured to the left and right rear shields 36*a*, 36*b* by inserting machine screws 36*c* through holes in the rear shields 36*a*, 36*b* and threading them through nuts 36*d* adjacent to the inner surfaces of the rear shields 36*a*, 36*b*. Adjacent abutting edges of the left and right rear shields 36*a*, 36*b* are configured with latches 37 that allow them to be locked in a closed position. The rear shields 36*a*, 36*b* have adjacent cut away portions 36*e* that allow coaxial cable access to the antenna radiator 23.

The top and bottom shields 39, 39*a*, 39*b* are pre-attached to the front and rear shields 34, 36*a*, 36*b*. The front top and bottom shields 39, 39*a*, 39*b* are designed from a material which does not impede radio frequency energy transmission or reception. The top and bottom shields 39, 39*a*, 39*b* may be designed as flat shields as shown or may be domed, hemispherical or any other desired aerodynamic shape.

FIGS. 13*a*-13*e* illustrate isometric, rear, side and sectional views of the standoff-bracket-mounted antenna 10*a* showing top and bottom shields 39, 39*a*, 39*b* used in the wind load reduction apparatus 30. The top and bottom shields 39, 39*a*, 39*b* are respectively secured to the front shield and left and right pairs of rear shields 34, 36*a*, 36*b*, such as by adhesive, for example. The top and bottom shields 39, 39*a*, 39*b* are made of a material that does not impede transmission or reception of radio frequency energy. The front and rear shields 34, 36*a*, 36*b*, in conjunction with the top and bottom shields 39, 39*a*, 39*b* encase the antenna radiator 23 in a round housing that is operative to reduce the wind load by a factor of from 45 to 65 percent.

The angle rail wind load reduction apparatus 30 described with reference to FIGS. 7*a* and 7*b* may be employed with standoff-bracket-mounted antennas 10*a* whose support brackets 11*a* are interconnected by angle rails 12. Although not shown in the drawing figures, angle rails 12 interconnect adjacent support brackets 11*a* of adjacent standoff-bracket-mounted antennas 10*a* in a manner similar to what is shown in FIGS. 7*a* and 7*b*. The angle rail wind load reduction apparatus 30 is attached to the angle rails 12 as described with reference to FIGS. 7*a* and 7*b*.

Figure 14:
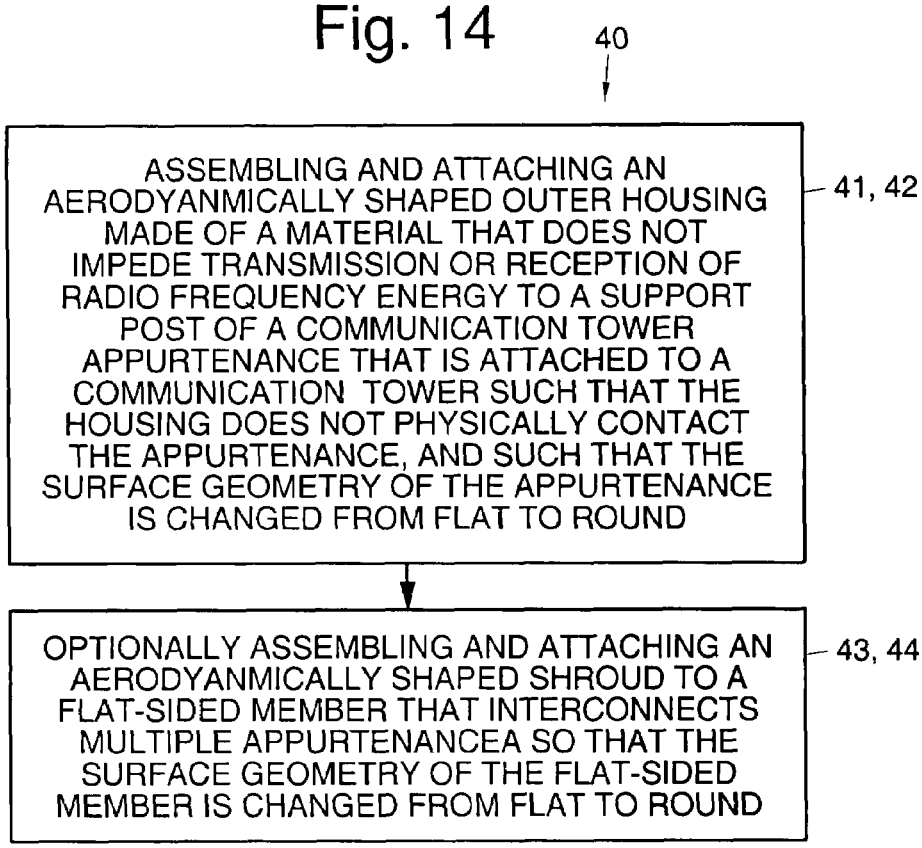
FIG. 14 is a diagram that illustrates an exemplary wind load reduction method, and Table 1 from the ANSI/TIA-222-G Code shows force coefficients (Ca) for appurtenances on communication towers.

FIG. 14 is a diagram that illustrates an exemplary wind load reduction method 40 for use with communication tower appurtenances. The exemplary wind load reduction method 40 may be implemented in the following manner.

An aerodynamically shaped outer housing made of a material that does not impede transmission or reception of radio frequency energy is assembled 41 and attached 42 to a support post of a communication tower appurtenance that is attached to a communication tower such that the housing does not physically contact the appurtenance, and such that the surface geometry of the appurtenance is changed from flat to round. Optionally, an aerodynamically shaped shroud may also be assembled 43 and attached 44 to a flat-sided member that interconnects multiple appurtenances so that the surface geometry of the flat-sided member is changed from flat to round.

Thus, apparatus and methods for reducing drag resulting from wind loads on telecommunication structures appurtenances have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. Wind load reduction apparatus for use in reducing drag resulting from wind loads on a pre-existing appurtenance attached to a communication tower, comprising:

an aerodynamically shaped outer housing made of a material that does not impede transmission or reception of radio frequency energy coupled to a support of a pre-existing appurtenance having an outer enclosure with at least one flat, general vertical, exterior surface that is exposed to wind loads, which aerodynamically shaped outer housing is attached to the communication tower such that the housing does not physically contact the appurtenance, and such that the surface geometry surrounding the appurtenance is changed from flat to round.

2. The apparatus recited in claim 1 further comprising:

one or more bracket clamps attached to the support;

one or more brackets respectively attached to the bracket clamps;

and wherein the outer housing comprises:

an aerodynamically shaped shield attached to the one or more brackets that surrounds the pre-existing appurtenance and changes its surface geometry from flat to round.

3. The apparatus recited in claim 2 wherein the aerodynamically shaped shield comprises:

an aerodynamically shaped front shield attached to the one or more hinge brackets;

one or more rear shields selectively attached to the bracket clamps or front shield; and top and bottom shields respectively coupled to tops and bottoms of the front and rear shields.

4. The apparatus recited in claim 3 wherein the one or more rear shields are made of a material that does not impede transmission or reception of radio frequency energy.

5. The apparatus recited in claim 1 further comprising:

an aerodynamically shaped shroud attached to a pre-existing flat-sided member that interconnects multiple pre-existing appurtenances that change its surface geometry from flat to round.

6. The apparatus recited in claim 1 wherein the pre-existing appurtenance comprises a platform-mounted communication antenna.

7. The apparatus recited in claim 1 wherein the pre-existing appurtenance comprises a standoff-bracket-mounted communication antenna.

8. A method for reducing drag resulting from wind loads on a pre-existing appurtenance attached to a communication tower, comprising:

assembling and attaching an aerodynamically shaped outer housing made of a material that does not impede transmission or reception of radio frequency energy to a support of a pre-existing communication tower appurtenance having an outer enclosure with at least one flat, generally vertical, exterior surface that is exposed to wind loads, which aerodynamically shaped outer housing is attached to the communication tower such that the housing does not physically contact the appurtenance, and such that the surface geometry surrounding the appurtenance is changed from flat to round.

9. The method recited in claim 8 further comprising:

assembling and attaching an aerodynamically shaped shroud to a pre-existing flat-sided member that interconnects multiple pre-existing appurtenances so that the surface geometry of the flat-sided member is changed from flat to round.

10. The method recited in claim 8 wherein the pre-existing appurtenance comprises a platform-mounted communication antenna.

11. The method recited in claim 8 wherein the preexisting appurtenance comprises a standoff-bracket-mounted communication antenna.

12. The method recited in claim 8 wherein the housing comprises:

one or more bracket clamps attached to the support;

one or more brackets respectively attached to the bracket clamps;

and wherein the outer housing comprises:

an aerodynamically shaped shield attached to the one or more brackets that surrounds the preexisting appurtenance and changes its surface geometry from flat to round.

13. The method recited in claim 12 wherein the aerodynamically shaped shield comprises:

an aerodynamically shaped front shield attached to the one or more hinge brackets;

one or more rear shields selectively attached to the bracket clamps or front shield; and top and bottom shields respectively coupled to tops and bottoms of the front and rear shields.

14. The method recited in claim 13 wherein the one or more rear shields are made of a material that does not impede transmission or reception of radio frequency energy.

* * * * *